United States Patent [19]

Chan et al.

[11] 4,036,682

[45] * July 19, 1977

[54] PAPER WITH SYNERGISTIC DRY STRENGTH ADDITIVES AND PROCESS THEREFOR

[75] Inventors: Lock-Lim Chan, Whitby; Arthur Herbert Guitard, Pickering, both of Canada

[73] Assignee: Borden, Inc., Columbus, Ohio

[ * ] Notice: The portion of the term of this patent subsequent to Feb. 8, 1994, has been disclaimed.

[21] Appl. No.: 590,314

[22] Filed: June 25, 1975

[51] Int. Cl.[2] ..... D21D 3/00

[52] U.S. Cl. ..... 162/167; 162/168 NA

[58] Field of Search ..... 162/166, 167, 168 NA; 427/391; 260/64, 828

[56] References Cited

U.S. PATENT DOCUMENTS 3,332,834 7/1967 Reynolds ..... 162/168 NA

FOREIGN PATENT DOCUMENTS 1,158,076 7/1969 United Kingdom

OTHER PUBLICATIONS

Linke, "Retention & Bonding of Synthetic Dry Strength Resins," Tappi (1968), vol. 51, No. 11, pp. 59A–65A.

*Primary Examiner*—S. Leon Bashore
*Assistant Examiner*—Peter Chin
*Attorney, Agent, or Firm*—George A. Kap; George P. Maskas; Daniel D. Mast

[57] ABSTRACT

Paper of high dry strength is produced by adding to a solution of fibers from 0.1 to 2% of a cationic resin and from 0.1 to 2% of an anionic resin. Proportion of cationic to anionic resin is in the range of 99:1 to 50:50. The preferred cationic resin is a condensation product of acetone, formaldehyde and polyalkylene polyamine which is prepared in presence of a catalytic amount of a strong inorganic acid and has a mol ratio of 1:3:0.5, respectively. The anionic resin is a copolymer of acrylamide and maleic acid or its anhydride having a mol ratio of from 90:10 to 98:2.

18 Claims, No Drawings

PAPER WITH SYNERGISTIC DRY STRENGTH ADDITIVES AND PROCESS THEREFOR

This invention relates to paper having high dry strength and negligible wet strength and to a process for its manufacture which is characterized by the use of a cationic resin in conjunction with an anionic resin. These resins combine to impart a synergistic effect in terms of dry strength of the paper. The cationic resin is a condensation product of a polyamine, a ketone and an aldehyde which are condensed at reflux temperature in presence of a catalytic amount of a strong inorganic acid. The anionic resin is a copolymer of acrylamide with maleic acid or its anhydride.

The use of the anionic and cationic resins individually to impart high dry strength and negligible wet strength to paper is known. The combination of the two resins, however, was found to impart synergistic effect in terms of dry strength paper.

Dry strength of paper is defined as the strength of the cellulosic web in its normally dry condition. A resin which is used to improve dry strength of paper must fulfill a number of requirements: It should improve the dry strength by at least 10% over the normal dry strength of paper, it should confer a low degree of wet strength and it should not adversely affect the drainage rate of the cellulose web on the papermaking machine.

A dry strength additive finds uses in most grades of paper such as linerboard, packaging, towels and tissues. Dry strength additive is particularly useful in enabling paper manufacturing industry to use weaker or recycled fibers. Recycling has been shown to have weakening effects on paper which can be counterbalanced by the use of a dry strength additive.

Dry strength additives are especially useful in the manufacture of paper from recycled fibers. It is the need for recycling paper that a suitable dry strength resin should not confer high wet strength to the paper so that no additional equipment and processing is needed for the eventual repulping.

The art of making dry strength paper dates prior to 1951 when the Azorlosa Canadian Pat. No. 477,265 issued. This patent discloses the use of an anionic copolymer of acrylamide or methacrylamide with acrylic or methacrylic acid together with alum. Pursuant to the Azorlosa's patent, paper of improved dry strength is manufactured by forming an aqueous suspension of cellulose papermaking fibers, adding thereto the anionic dry strength resin copolymer and alum, and sheeting the suspension. The resulting paper possesses much better dry strength than normal paper and possesses virtually no wet strength so that it can be easily repulped.

It is a disadvantage of the Azorlosa process, however, that the paper is produced at the pH of 4.5 to 5. Paper produced at pH of about 4.5 is significantly acid and undergoes acid tendering on aging. Moreover, papermaking systems operating at this pH level impart a significant amount of corrosion to the apparatus under conditions of constant use and require strict control of pH. As a result, efforts have been made to discover means for increasing the operating pH range of papermaking systems producing dry strength paper of the type just described without sacrificing the dry strength developed by the resin.

The close control of pH described in the prior art has been obviated by the invention described herein which allows manufacture of dry strength paper in a pH range of about 4 to 9, preferably 5.5 to 8, without weakening the resin to cellulose bond. This has been accomplished by the use of a cationic polymer of acetone, formaldehyde, polyalkylene polyamine with a small, catalytic amount of an inorganic acid and a copolymer of acrylamide with maleic acid or its anhydride.

The preferred reactants for the cationic resin herein include acetone, formaldehyde, diethylene triamine and hydrochloric acid. Mol ratio of acetone/formaldehyde/diethylene triamine can vary widely. Using acetone as a basis of 1 mol, amount of formaldehyde can vary from 1.8 to 4 mols although 3 mols of formaldehyde to 1 mol of acetone is preferred. The amine can vary from 0.1 to 1 mol per mol of acetone, the preferred amount being about 0.5 mol. Amount of the acid can vary from a negligible amount to 0.3 mol per each mol of acetone, although 0.05 mol is preferred. Within these permissible ranges, an increase in the mol ratio of formaldehyde to acetone generally increases the wet and dry strength properties while a decrease in amount of amine, favors the dry strength property. The choice of the mol ratios depends on the desired degree of dry strength improvement and the acceptable level of wet strength for a specific grade of paper.

In addition to acetone, other suitable ketones include such acetone homologs as methyl ethyl ketone, methyl n-propyl ketone, hexanone-2, hexanone-3, chloroacetone, and bromoacetone. Suitable ketones are unsubstituted and contain from 3 to about 8 carbon atoms per molecule with at least one reactive hydrogen atom at the alpha carbon position.

Other suitable aldehydes in addition to formaldehyde include acetaldehyde, propionaldehyde, n-butyraldehyde, isobutyraldehyde and n-valeraldehyde. Suitable aldehydes contain from 1 to about 5 carbon atoms per molecule.

Hydrochloric acid can be replaced by other strong inorganic acids such as hydrobromic, sulfuric and nitric.

Suitable polyamines in addition to the preferred diethylene triamine include alkylene diamines such as ethylene diamine and propylene diamine; and polyalkylene polyamines containing from 2 to 3 carbon atoms in the alkylene moiety and from 2 to 6 amine groups, preferably from 2 to 5 amine groups. Examples of suitable polyalkylene polyamines include tetraethylene pentamine, triethylene tetramine, diethylene triamine and a commerical product of Union Carbide sold as mixed amines PM-1953 which is a mixture of about $\frac{1}{3}$ mol fraction of diethylene triamine and about $\frac{2}{3}$ mol fraction of triethylene tetramine. The polyamines should contain a total of 2 to 10 carbon atoms, preferably 4 to 8, and should have at least 2 reactive hydrogens which can participate in the reaction with a ketone and an aldehyde.

The reaction for preparing the cationic resin is carried out at reflux temperature of about 95° C although temperatures in the range of 60° to 110° C are suitable to a degree. The reactants are mixed with sufficient water to yield a condensate of about 20% solids concentration. The pH of the reaction mixtures can be acid or alkaline but preferably, it should be above 7, as for instance 8 to 10. The reaction is carried out until the polymer reaches at least 10 cps Brookfield viscosity of a 20% solids solution measured at the refluxing temperatue of about 95° C with LVF No. 2 spindle at 60 rpm and as close to the gel point as possible. The preferred degree of condensation is represented by Brookfield viscosity of 40 to 60 cps measured at the same conditions. Generally speaking, the reaction can be carried out until the reaction mixture reaches gelation as evidenced by a rapid increase in Brookfield viscosity as measured at 95° C by LVF No. 2 spindle at 60 rpm.

The cationic resin is prepared by charging the following to a reactor with agitation and cooling:

a. polyamine
b. water
c. inorganic acid
d. ketone, and
e. aldehyde

Aldehyde, such as 50% aqueous solution of formaldehyde, is added to the reactor with cooling at such a rate that the temperature is not allowed to exceed 40° C. Agitation of the mixture is continued at about 40° C for about one-half hour and then the mixture is heated to reflux and maintained at reflux for about 2 hours. After this period of time, Brookfield LVF No. 2/60 viscosity of the reaction product is measured every 15 minutes until 30 cps is reached and then it is measured every 5 minutes until 50 cps is reached. Water is added in order to terminate condensation at this point. The condensate is mixed for about one half hour without cooling and then cooled to room temperature.

The preferred cationic resin has the following physical properties:

solids: 12% ± 1
Brookfield Viscosity (LVF No. 2/10/25° C): 20 cps ± 5
pH: 8.5 ± 0.5

The anionic resin is a copolymer of acrylamide and maleic acid or maleic anhydride or a copolymer of acrylamide or methacrylamide with acrylic or methacrylic acids. The preferred acrylamide/maleic acid copolymer has a mol ratio of from 90:10 to 98:2, preferably 95:5, and has a molecular weight of from 0.5 to 6.0 dl/g, preferably from 1.0 to 1.5 dl/g, as represented by intrinsic viscosity measured in 0.1 N NaCl solution at 25° C. This copolymer is polymerized in aqueous solution using common initiator such as potassium persulfate. The acrylamide/maleic acid copolymer has the following preferred physical properties:

solids: 20% ± 1
Brookfield Viscosity (LVF No. 4/30/90° C): 400 to 800 cps
pH: 6 to 7

The other anionic copolymer is closed in the Canadian Pat. No. 477,265 issued to Azorlosa on Sept. 25, 1951. This product is a copolymer of acrylamide or methacrylamide with acrylic or methacrylic acids wherein the respective mol ratio is from 99:1 to 75:25%, preferably from 95:5 to 88:12%. Suitable specific viscosity (Ubbelohde) of this copolymer is between 0.2 and 100, preferably from 1 to 10, measured in a 0.5% aqueous solution.

The cationic resin is added in excess of the anionic resin for synergistic effect, the weight ratio being from 99:1 to 50:50, preferably from 90:10 to 70:30. Generally, however, total amount of the resin used is from 0.05 to 3%, preferably from 0.1 to 2%, of the cationic resin and from 0.05 to 3%, preferably from 0.1 to 2% of the anionic resin, based on the dry weight of the cellulosic fibers.

In accordance with the instant invention, dry strength paper can be manufactured under normal papermaking conditions by the use of a cationic acetone/formaldehyde/polyamine condensate in conjunction with the anionic resins described above. Synergism of these two resins occurs in the range specified above. The best composition should be found empirically for each papermaking system. Experience shows that a ratio larger than 1 cationic resin to anionic polymer is preferred in order to achieve more pronounced effect and better economic values. In other words, in a very specific sense, this invention relates to the use of an anionic acrylamide/maleic acid or acrylamide/acrylic acid copolymer to improve the performance of a specific cationic dry strength resin making use of unexpected synergysm.

The resins described above are used in aqueous solutions under normal papermaking conditions in amounts required by the papermaking industry to achieve its objectives. Generally, the use of 0.1 to 5%, preferably from 0.2 to 2% of the dry resin on the basis of dry pulp will provide sufficient improvement in bursting and tensile strengths. The resins are preferably added at points in the paper machine where all the cleaning and refining processes have been complete, i.e., refined stock chest, head box, fan pump, machine chest, etc. The cationic resin is prefereably added after addition of the anionic resin and the cationic resin is preferably added at a point as close to the wire as possible. The resin can improve dry strength of furnishes when the pulp is maintained in the pH range of 4 to 9, depending on the acceptable degree of wet strength. For those desiring a lower degree of wet strength, pH of the pulp should be in escess of 5.5. The resin can confer dry strength to paper and improve drainage of stock on the wire preferably at pH of above 5.5 to about 8. Sufficient dry strength improvement can be achieved under normal papermaking conditions without post heat curing.

The resins described above can be used with all standard papermaking furnishes, including recycled papers. The utility of this invention is not limited to the particular type of paper pulp used; and, accordingly, this invention may be utilized with the various types of kraft, soda, sulfite pulp, ground wood, and the like, as well as with other chemical and semichemical paper pulps. By the same token, the invention may be utilized with various types of paper products such as paper, linerboard, molded pulp products, and the like. In all instances, the product produced by this invention is characterized by having an increased dry strength and other improved properties.

The papermaking process for utilizing the resins described herein includes the addition of dilute aqueous solutions of the resins at a suitable point prior to such formation. In normal papermaking procedures, the paper stock is beaten to a Canadian Standard Freeness of 200 to 650 ml and consistency of the aqueous suspension of the cellulosic fibers can vary up to 10%; however, the preferred range is 0.1 to 5%.

While the cationic resin is preferably added after the anionic resin, minor variation is permissible. For example, in paper mills constructed with a partially closed system, the recycled white water may contain certain amount of cationic and anionic resin and therefore, in practice, the preferred order of addition would have altered to some extent. Both of the resins are added after all the refining of pulp has been completed.

Several examples are presented below which illustrate preparation of the cationic and the anionic resins and which substantiate the synergistic performance of the resins when used in combination.

EXAMPLE I — Preparation of Cationic Resin

To a three necked flask equipped with a thermometer, a mechanical stirring device, sampling tube and a condenser, the following were added and mixed:

water: 237.6 grams
concentrated hydrochloric acid: 2.6 grams
mixed amine: 27.6 grams
acetone: 29.6 grams
formaldehyde: 90.0 grams The mixed amine is a commercial product supplied by Union Carbide as Mixed Amine PM-1953 which contains approximately ⅓ mol fraction of diethylene triamine and ⅔ mol fraction of triethylene tetramine. Formaldehyde was added in 50% aqueous solution. The solution was heated gradually to refluxing at about 92° C. The reaction was stopped by adding 387.4 grams of water when it reached a Brookfield viscosity of 60 cps, LVF spindle No. 2 at 60 rpm and 92° C. The final product had the following properties:

solids: 9.4%
Brookfield Viscosity (LVF No. 2/60/25° C): 14.0 cps
pH: 9.0

EXAMPLE II — Preparation of Anionic Resin

To a pilot plant kettle equipped with mechanical agitation device, feeding pumps, and temperature control, the following materials were added and allowed to react:

| | |
|---|---|
| (1) water | 58.7 kg |
| (2) Sequestrene[R] No. 22 | 0.01 kg |
| (3) premix (A) | |
| (a) water | 31.8 kg |
| (b) acrylamide | 29.4 kg |
| (c) water | 13.0 kg |
| (d) maleic anhydride | 2.15 kg |
| (e) NaOH (26° Be) | 1.20 kg |
| (4) premix (B) | |
| (a) water | 11.3 kg |
| (b) potassium persulfate | 95.3 gr |
| (5) premix (C) | |
| (a) water | 7.6 gr |
| (b) potassium persulfate | 145.0 gr |
| (6) premix (D) | |
| (a) water | 2.5 kg |
| (b) sodium bisulfite | 0.9 gr |

After (1) and (2) were added and heated to about 100° C, (3) and (4) were fed into the reactor by the use of the feeding pump at such a rate that the additions of the two premixes were completed at the same time. Then (5) and (6) were added. The reaction was allowed to continue for 4 hours after the start of the feeding process. The product had the following properties:

solids: 20.0%
Brookfield Viscosity (LVF No. 4/60/25° C): 5,000 cps
pH: 5.2

EXAMPLE III — Evaluation of Resins

Effect of the additives on the strength of paper was evaluated by adding various amounts of the cationic and the anionic polymers prepared in accordance with Examples I and II, respectively. These polymers were added separately, and in conjunction with each other.

A refined unbleached kraft furnish from recycled kraft boxes was obtained from the stock chest of the paper machine of a local paper mill. The consistency was 3.5%, Canadian Standard Freeness was 426 ml, and the pH was 7.0. This stock was diluted to a consistency of 0.25%.

To 1 liter aliquots of this stock slurry, various amounts of polymer samples prepared in examples I and II were added such that the percentages of resin based on dry pulp were as shown in Table 1.

This slurry was emptied into a Williams Sheet Mold containing sufficient water for the total solution to reach a standard volume. The water was drained and covered with a blotter and then pressed overnight with a Williams Sheet Press at 100 psi. The sheets were then dried in an Emerson Speed Drier model 10 for 3 minutes at 240° F. The sheets were cured in an oven at 105° C for 10 minutes and conditioned at room temperature overnight. The bursting strength was tested by the use of a B. F. Perkins hand-driven Mullen tester and an average of eight values was reported. The results are shown in Table 1, below.

TABLE 1

SYNERGISTIC EFFECT OF CATIONIC AND ANIONIC RESINS

| CATIONIC RESIN | ANIONIC RESIN | BURSTING STRENGTH psi | BURSTING STRENGTH % Increase |
|---|---|---|---|
| 0 | 0 | 17.23 | — |
| 0.2 | 0 | 19.66 | 14.1 |
| 0.4 | 0 | 20.77 | 20.5 |
| 0.2 | 0.2 | 22.31 | 29.5 |
| 0.6 | 0 | 22.06 | 28.0 |
| 0.4 | 0.2 | 23.75 | 37.8 |
| 0.2 | 0.4 | 22.56 | 30.9 |
| 0.8 | 0 | 24.55 | 42.5 |
| 0.6 | 0.2 | 26.76 | 55.3 |
| 0.4 | 0.4 | 26.83 | 55.7 |
| 1.0 | 0 | 24.88 | 44.4 |
| 0.8 | 0.2 | 28.04 | 62.7 |
| 0.2 | 0.8 | 21.80 | 27.0 |
| 1.0 | 0.2 | 29.44 | 70.9 |
| 0 | 1.5 | 20.18 | 17.1 |

It is apparent, on the basis of the above results, that the use of an anionic polymer in conjunction with cationic polymer provides a synergistic effect in terms of dry strength of the treated paper. It should also be noted that without cationic resin, the anionic resin gave a very low dry strength improvement of 17.1% even at a high resin level of 1.5%; note the last entry in the above table.

EXAMPLE IV — Evaluation of Resins with Another Furnish

Polymer samples prepared as in Examples I and II were used with a different furnish in a way similar to Example III. The furnish was composed of 85% repulped corrugated waste and 15% repulped newspaper. The furnish, as received, had a Canadian Standard Freeness of 326 ml, and a pH of 7.4 at a consistency of 0.25%. The results are summarized in Table 2, below.

TABLE 2

| CATIONIC RESIN | ANIONIC RESIN | BURSTING STRENGTH psi | BURSTING STRENGTH %Increase |
|---|---|---|---|
| 0 | 0 | 19.8 | — |
| 0.4 | 0 | 20.9 | 5.6 |
| 0.3 | 0.1 | 22.4 | 13.1 |
| 0.2 | 0.2 | 21.1 | 6.6 |
| 1.0 | 0 | 24.4 | 23.2 |
| 0.9 | 0.1 | 24.6 | 24.2 |
| 0.8 | 0.2 | 25.2 | 28.9 |
| 0.75 | 0.25 | 25.9 | 30.8 |

The snyergistic effect of the two resins is evident from the above data. As was already noted, it is preferred to add an excess of the cationic resin over the anionic resin. This is demonstrated by the experiment where 0.2% of each resin was used and the other experiments where an excess of cationic resin was added.

The invention herein has been described and illustrated with a number of examples which demonstrate synergysm of the cationic and anionic resins when used in combination. It should be understood, however, that minor modifications may be made without departing from the spirit of our invention and it is intended to have such minor modifications covered by the appended claims. An example of such modification is the use of an additional monomer or monomers in small amounts in the preparation of the resins which would not change the character of the resins for the purpose described herein.

We claim:

1. The process for the manufacture of paper of improved dry strength and negligible wet strength comprising forming an aqueous suspension of fibrous cellulosic material containing a cationic polymer prepared in an aqueous medium having pH of about 8 to 10 and an anionic polymer in the respective weight ratio of from 99:1 to 50:50 which is sufficient to impart synergistic dry strength to the paper, sheeting the cellulosic material to form a web and drying the web; the cationic polymer being a reaction product of a ketone, an aldehyde and a polyamine, the mol ratio of reactants being from 1.8 to 4 mols of the aldehyde and from 0.1 to 1 mol of the polyamine per mol of the ketone; the anionic polymer is selected from the group consisting of (a) polymers of acrylamide and maleic acid or derivatives thereof in respective mol ratio of from 90:10 to 98:2, (b) polymers of acrylamide or methacrylamide with acrylic or methacrylic acid in respective mol ratio of from 90:10 to 98:2, and (c) mixtures of the two polymers.

2. Process of claim 1 including the steps of sheeting the cellulosic material to form a web and drying the web; the ketone of the cationic polymer is selected from ketones containing from 3 to 8 carbon atoms per molecule with at least one reactive hydrogen at the alpha carbon position, the aldehyde is selected from aldehydes containing from 1 to 5 carbon atoms, and the polyamine is selected from alkylene diamines and polyalkylene polyamines containing from 2 to 3 carbon atoms in the alkylene moiety and from 2 to 6 amine groups; the cationic polymer is prepared by reacting the reactants in the presence of a catalytic amount of a strong inorganic acid in an aqueous medium.

3. Process of claim 2 wherein the aqueous suspension of cellulosic material is at pH of 4 to 9; the anionic polymer is a copolymer of acrylamide with maleic acid or maleic anhydride; Brookfield viscosity of a 20% solids solution of the cationic polymer is from 10 cps, measured on LVF No. 2 spindle at 60 rpm and 95° C, to its gelation point; amount of the cationic polymer is from 0.05 to 3% and that of the anionic polymer is also from 0.05 to 3% by weight of the dry cellulosic material; and pH of the cationic polymer in aqueous medium is from 8 to 10.

4. Process of claim 3 wherein amount of the cationic polymer is from 0.1 to 2% and of the anionic polymer it is also from 0.1 to 2%; intrinsic viscosity of the anionic polymer measured in a 0.1 N NaCl solution at 25° C is in the range of 0.5 to 6 dl/g.

5. Process of claim 4 wherein the ketone is acetone, the aldehyde is formaldehyde and the amine is polyethylene polymine containing from 2 to 6 amine groups; amount of the acid used in the reaction is up to about 0.3 mol; relative amount of the cationic polymer to the anionic polymer is from 90:10 to 70:30; and intrinsic viscosity of the anionic polymer is from 1.0 to 1.5 dl/g.

6. Process of claim 6 wherein molar ratio of the reactants for preparing the cationic resin is 3 mols of formaldehyde and 0.5 mols of polyethylene polyamine per mol of acetone; the acid is hydrochloric acid; the cationic polymer is prepared at reflux temperature and 20% aqueous solution thereof has Brookfield viscosity of 40 to 60 cps measured on LVF No. 2 spindle at 60 rpm and about 95° C.

7. Paper having improved dry strength and negligible wet strength comprising fibrous cellulosic material and a cationic polymer prepared in an aqueous medium having pH of about 8 to 10 and an anionic polymer in the respective weight ratio from 99:1 to 50:50 which is sufficient to impart synergistic dry strength to the paper, the cationic polymer being a reaction product of a ketone, an aldehyde and a polyamine, the mol ratio of reactants being from 1.8 to 4 mols of the aldehyde and from 0.1 to 1 mol of the polyamine per mol of the ketone; the anionic polymer is selected from the group consisting of (a) polymers of acrylamide and maleic acid or derivatives thereof in respective mol ratio from 90:10 to 98:2, (b) polymers of acrylamide or methacrylamide with acrylic or methacrylic acid in respective mol ratio of from 99:1 to 75:25, and (c) mixtures of the two polymers.

8. Paper of claim 7 wherein the ketone of the cationic polymer is selected from ketones containing from 3 to 8 carbon atoms per molecule with at least one reactive hydrogen at the alpha carbon position, the aldehyde is selected from aldehydes containing from 1 to 5 carbon atoms, and the polyamine is selected from polyalkylene polyamines containing from 2 to 3 carbon atoms in the alkylene moiety and from 2 to 6 amine groups; the cationic polymer is prepared by reacting the reactants in the presence of a catalytic amount of a strong inorganic acid.

9. Paper of claim 8 wherein the anionic polymer is a copolymer of acrylamide with maleic acid or maleic anhydride; Brookfield viscosity of a 20% solids solution of the cationic polymer is from 10 cps, measured on LVF No. 2 spindle at 60 rpm and 95° C, to its gelation point; amount of the cationic polymer is from 0.05 to 3% and of the anionic polymer it is also from 0.05 to 3% by weight of the dry cellulosic material.

10. Paper of claim 9 where amount of the cationic polymer is from 0.1 to 2% and of the anionic polymer it is also from 0.1 to 2%; intrinsic viscosity of the anionic polymer measured in a 0.1 N NaCl solution at 25° C is in the range of 0.5 to 6 dl/g.

11. Paper of claim 10 wherein the ketone is acetone, the aldehyde is formaldehyde and the amine is polyethylene polyamine containing from 2 to 5 amine groups; amount of the acid used in the reaction is up to about 0.3 mol per mol of acetone; relative amount of the cationic polymer to the anionic polymer is from 90:10 to 70:30; and intrinsic viscosity of the anionic polymer is from 1.0 to 1.5 dl/g.

12. Paper of claim 11 wherein molar ratio of the reactants for preparing the cationic resin is 3 mols of formaldehyde and 0.5 mol of polyethylene polyamine per mol of acetone; the acid is hydrochloric acid; the cationic polymer is prepared at reflux temperature and 20% aqueous solution thereof has Brookfield viscosity of 20 to 60 cps measured on LVF No. 2 spindle at 60 rpm and about 95° C.

13. Process for the manufacture of paper of improved dry strength and negligible wet strength comprising forming an aqueous suspension of fibrous cellulosic material containing a fixing agent selected from the group consisting essentially of cationic polymers prepared in an aqueous medium having pH of about 8 to 10 and a dry strength resin selected from the group consisting essentially of anionic polymers in the respective weight ratio of from 99:1 to 50:50 which is sufficient to impart synergistic dry strength to the paper, sheeting the cellulosic material to form a web and drying the web; the cationic polymer being a reaction product of a ketone, an aldehyde and a polyamine where the mole ratio of reactants is from 1.8 to 4 mols of the aldehyde and from 0.1 to 1 mol of the polyamine per mol of the ketone; the anionic polymer is selected from the group consisting of (a) polymers of acrylamide and maleic acid or derivatives thereof in respective mol ratio of from 90:10 to 98:2 (b) polymers of acrylamide or methacrylamide with acrylic or methacrylic acid in respective mol ratio of from 99:1 to 75:25, and (c) mixtures of the two polymers.

14. Process of claim 13 wherein the ketone of the cationic polymer is selected from ketones containing from 3 to 8 carbon atoms per molecule with at least one reactive hydrogen at the alpha carbon position, the aldehyde is selected from aldehydes containing from 1 to 5 carbon atoms, and the polyamine is selected from alkylene diamines and polyalkylene polyamines containing from 2 to 3 carbon atoms in the alkylene moiety and from 2 to 6 amine groups; the cationic polymer is prepared by reacting the reactants in the presence of a catalytic amount of a strong inorganic acid in an aqueous medium.

15. Process of claim 14 wherein the aqueous suspension of cellulosic material is at pH of 4 to 9; the anionic polymer is a copolymer of acrylamide with maleic acid or maleic anhydride; Brookfield viscosity of a 20% solids solution of the cationic polymer is from 10 cps, measured on LVF No. 2 spindle at 60 rpm and 95° C, to its gelation point; amount of the cationic polymer is from 0.05 to 3% and that of the anionic polymer is also from 0.05 to 3% by weight of the dry cellulosic material; and pH of the cationic polymer in aqueous medium is from 8 to 10.

16. Process of claim 15 wherein amount of the cationic polymer is from 0.1 to 2% and of the anionic polymer it is also from 0.1 to 2%; intrinsic viscosity of the anionic polymer measured in a 0.1 N NaCl solution at 25° C is in the range of 0.5 to 6 dl/g.

17. Process of claim 16 wherein the ketone is acetone, the aldehyde is formaldehyde and the amine is polyethylene polyamine containing from 2 to 6 amine groups; amount of the acid used in the reaction is up to about 0.3 mol; relative amount of the cationic polymer to the anionic polymer is from 90:10 to 70:30; and intrinsic viscosity of the anionic polymer is from 1.0 to 1.5 dl/g.

18. Process of claim 17 wherein molar ratio of the reactants for preparing the cationic resin is 3 mols of formaldehyde and 0.5 mols of polyethylene polyamine per mol of acetone; the acid is hydrochloric acid; the cationic polymer is prepared at reflux temperature and 20% aqueous solution thereof has Brookfield viscosity of 40 to 60 cps measured on LVF No. 2 spindle at 60 rpm and about 95° C.

* * * * *